US005412959A

United States Patent [19]

Bentley

[11] Patent Number: 5,412,959

[45] Date of Patent: May 9, 1995

[54] GUN LOCK ASSEMBLY

[76] Inventor: James K. Bentley, 29100 N. Lower Valley Rd., Tehachapi, Calif. 93561

[21] Appl. No.: 155,805

[22] Filed: Nov. 23, 1993

[51] Int. Cl.[6] ..... E05B 65/00; F41A 17/02

[52] U.S. Cl. ..... 70/30; 70/57; 42/66; 42/70.11

[58] Field of Search ..... 70/14, 18, 30, 49, 57, 70/58; 42/1.13, 44, 66, , 70.06, 70.11

[56] References Cited

U.S. PATENT DOCUMENTS

| | | | |
|---|---|---|---|
| 1,627,462 | 5/1927 | Rohmer | 70/30 |
| 2,327,334 | 8/1943 | Parker | 70/57 X |
| 2,479,107 | 8/1949 | Garretson | 42/70.11 X |
| 3,022,598 | 2/1962 | Wikstrom | 42/66 |
| 3,137,957 | 6/1964 | Ingalls | 42/70.11 |
| 3,368,297 | 2/1968 | Lentz | 42/66 X |
| 3,768,189 | 10/1973 | Goodrich | 70/57 X |
| 4,302,955 | 12/1981 | Kawakami | 70/30 |
| 4,999,940 | 3/1991 | Madden | 42/70.11 X |
| 5,048,212 | 9/1991 | Mossberg | 42/70.06 X |
| 5,271,174 | 12/1993 | Bentley | 42/70.11 |

*Primary Examiner*—Peter M. Cuomo
*Assistant Examiner*—Suzanne L. Dino
*Attorney, Agent, or Firm*—Charles C. Logan, II

[57] ABSTRACT

A gun lock assembly formed of two major components, an elongated rod member and a predetermined length of flexible cable whose opposite ends can be secured together with a lock. The elongated rod member has a shank portion having a predetermined length and a head portion formed on its front end. The shank portion has sufficient length to extend into the breech of a gun. The head portion has an aperture through which the cable is threaded. The cable is also threaded through a trigger guard and locked. The flexible cable has a predetermined length such that the rod member cannot be removed from the gun barrel without unlocking the lock.

6 Claims, 1 Drawing Sheet

GUN LOCK ASSEMBLY

BACKGROUND OF THE INVENTION

The invention relates to a lock assembly and more specifically to a gun lock assembly.

A major concern of owners of guns is the fact children may gain unauthorized access to guns with the consequence of someone being injured or killed. There is also concern that a young person or adult could use the gun in anger against another person.

Presently there are gun lock devices on the market that have not been entirely satisfactory. Some of these lock into the trigger guard behind the trigger thereby preventing the trigger being pulled. Often times this device can be pried apart and removed. Also this device does not insure that there is not a live bullet in the chamber. Other devices on the market allow the weapon to be secured to a wall structure. Gun cabinets that can be locked are often mounted on a wall and many of them have pane glass doors that can be broken into providing access to the guns.

It is an object of the invention to provide a novel gun lock assembly that will prevent installation of the gun lock assembly if there is a bullet in the chamber of the gun.

It is another object of the invention to provide a novel gun lock assembly that is economical to manufacture and market.

It is a further object of the invention to provide a novel gun lock assembly that is easily and quickly installed or removed from a gun.

It is an additional object of the invention to provide a novel gun lock assembly that can be used to secure both hand guns and rifles.

SUMMARY OF THE INVENTION

Applicant's novel gun lock assembly has been designed to prevent accidents to children and adults. The prevention of a shooting accident by a child or adult finding an unlocked revolver or rifle is the purpose of this gun lock assembly.

The gun lock assembly allows the owner to display his firearms openly in a room in his home or office without the need for an expensive closed cabinet for storing them. The novel gun lock assembly gives the owner peace of mind knowing that once the gun lock assembly has been installed on a gun, not only is there no bullet in the breech chamber, there is also no way in which a bullet can be loaded into the breech chamber. The gun lock assembly when secured on a gun has sufficient structural integrity that a child is not going to be able to remove it.

The gun lock assembly is formed of two major components, an elongated steel rod member and a predetermined length of flexible cable that has a lock for securing its opposite ends together.

The rod member has a head portion whose diameter is greater than the bore of a gun barrel and it has an aperture passing laterally there through. The elongated shank portion has a diameter small enough to easily travel along the interior of the bore of the gun barrel. The length of the shank portion is such that it extends into the breech area of the gun thereby giving immediate notice if there is a bullet in the breech and once installed prevents a bullet from being loaded into the breech chamber.

The flexible cable is preferably made of stranded wire covered by a plastic coating. It has a predetermined length that is at least long enough to pass through the central aperture of the trigger guard and also through the aperture in the head portion of the rod member so that the opposite ends of the cable can be secured together by a lock. The predetermined length of the cable would also be calculated so that the rod member cannot be removed from the breech chamber when the ends of the cable are locked together. In a preferred embodiment of the invention, a tumbler combination lock would have its opposite ends secured to the opposite ends of the cable.

The gun lock assembly provides a range of different guns that can be locked securely with cables having a predetermined length and rod members having a predetermined length. This allows a small number of different sized gun lock assemblies to be installed on a wide range of guns. The various gun lock assemblies must merely have rod members having different length shank portions and different lengths of cable for them to perform in the required manner for different sized guns. In essence, short barreled guns will have short cables and long barrel guns will have the longest rod members and cables. Also, due to the relationship of the length of the rod member and the cable member, you can't put a gun lock assembly that has been designed for a short gun on a long gun, so there is no way you can put on a gun with a round in the chamber.

DESCRIPTION OF THE PREFERRED EMBODIMENT

Figure 1:
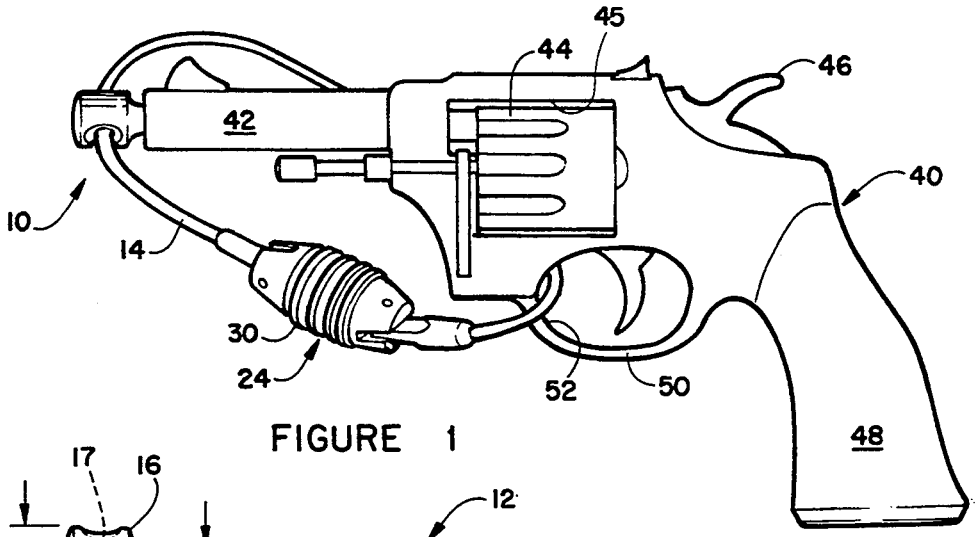
FIG. 1 is a side elevation view showing the novel gun lock assembly installed on a pistol.
Figure 2:
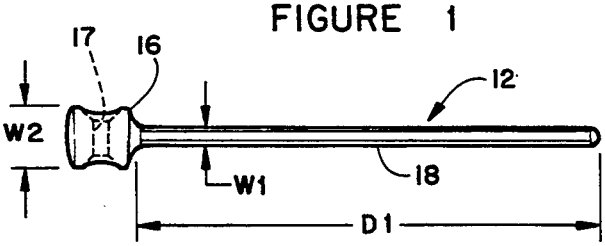
FIG. 2 is a side elevation view of the rod member.
Figure 3:
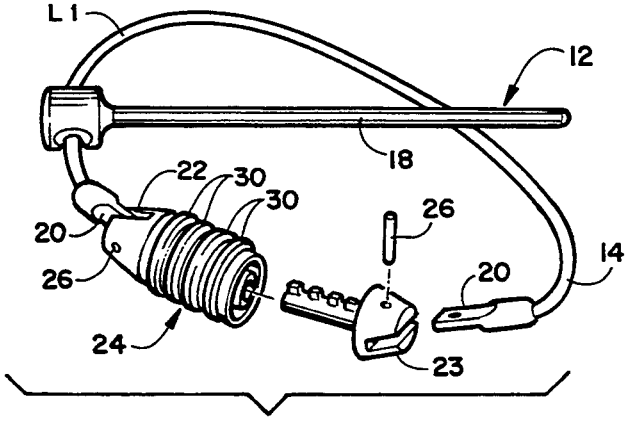
FIG. 3 is a perspective view of the novel gun lock assembly removed from the pistol.
Figure 4:
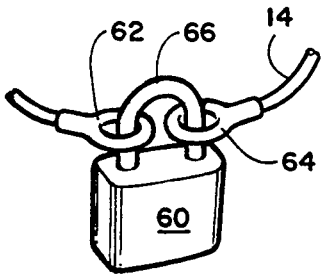
FIG. 4 illustrates an alternative structure for locking the ends of the cable together.

The novel gun lock assembly will now be described by referring to FIGS. 1–5. The gun lock assembly is generally designated numeral 10 and its primary components are rod member 12 and cable 14.

Rod member 12 has a head portion 16 having a transversely extending bore or aperture 17. Shank portion 18 has a predetermined length D1 and a predetermined diameter W1. The head portion has a predetermined diameter W2 which would be greater than the bore diameter of any gun barrel with which it would be used.

Cable 14 has metal tongues 20 extending from its opposite ends. These tongue members are received in respective clevis members 22 and 23 of the tumbler combination lock 24. Pins 26 secure these respective tongue members to the respective clevis members. Tumbler combination lock 24 has a plurality of rotatable rings 30 having numbers on them for dialing in the combination.

Figure 5:
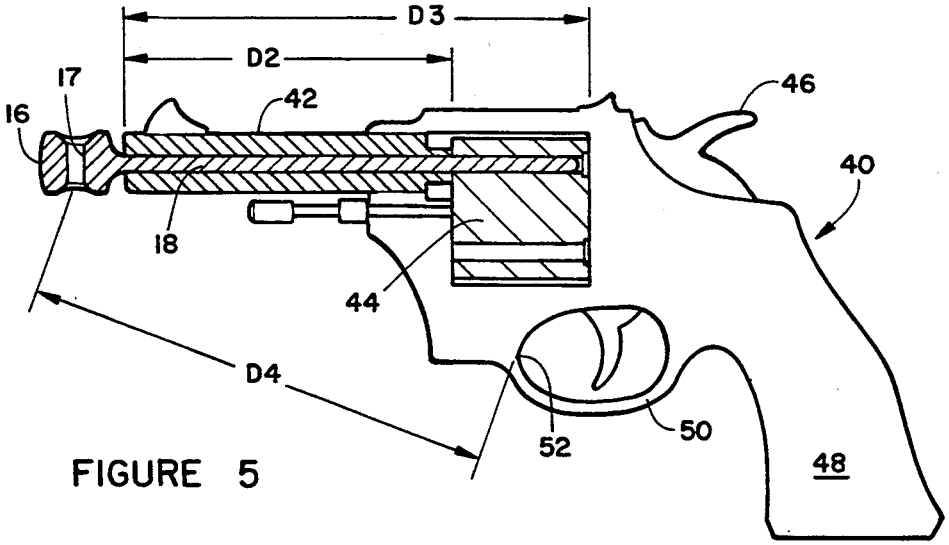
FIG. 5 is a schematic view illustrating the different important measurements involved in the gun lock assembly.

In FIG. 5, the schematic illustration of the gun shows the important length considerations to the different structural members. The gun is generally designated numeral 40. It has a gun barrel 42, a revolving cylinder 44, a breech chamber 45, a hammer 46, a handle 48 and a trigger guard 50. The distance from the front end of gun barrel 42 to the front end of breech chamber 44 is D2. The distance from the front end of gun barrel 42 to the rear end of breech chamber is D3. The distance from aperture 17 in rod member 12 to the aperture 52 of trigger guard 50 is D4. It is important that the length L1 of cable 14 be at least equal to 2×D4.

What is claimed is:

1. A gun lock assembly in combination with a gun having a gun barrel having a front end and a rear end, said gun having a breech located at the rear end of said gun barrel having a front end and a rear end, said gun having a trigger guard having a central aperture, comprising:

an elongated rod member having a front end and a rear end, said rod member having a hear portion integrally formed at its front end, said head portion having an aperture therein, a shank portion extends rearwardly from said head portion and has a predetermined length D1 which would be inserted into the front end of said gun barrel;

an elongated flexible cable having a predetermined length having a front end and a rear end, said cable being removably threaded through the aperture in the head portion of said rod member; and means for locking the front and rear ends of said cable together after the cable has been threaded together through (the) said trigger guard of said gun.

2. A gun lock assembly as recited in claim 1 wherein said means for locking the front and rear ends of said cable together is a combination lock.

3. A gun lock assembly as recited in claim 2 wherein said combination lock has a left end with a clevis formed thereon and a right end with a clevis formed thereon and said lock has a plurality of rotatable rings having numbers on them.

4. A gun lock assembly as recited in claim 1 wherein the distance from the front of said gun barrel to the front end of said breech is D2, the distance from the front end of said gun barrel to the rear end of said breech is D3, the distance from the aperture in the head portion of said rod member, when inserted in said gun barrel, to said trigger guard is D4 and wherein the length L1 of said cable is at least equal to 2D4 and is less than 2D4+2D3; and the D1 length of the shank portion of said rod member is greater than D2.

5. A gun lock assembly as recited in claim 4, wherein the length of D1 of the shank portion of said rod member is substantially equal to D3.

6. A gun lock assembly as recited in claim 4 wherein the width W1 of said shank portion is less than the inner diameter of the bore of said gun barrel and the width W2 of said head portion is greater than the inner diameter of the bore of said gun barrel.

* * * * *